United States Patent [19]

Rofe

[11] 4,146,207

[45] Mar. 27, 1979

[54] METERING DRAIN PLUG

[76] Inventor: Arthur D. Rofe, 2010 Meadow Ridge, Walled Lake, Mich. 48088

[21] Appl. No.: 803,178

[22] Filed: Jun. 3, 1977

[51] Int. Cl.[2] ..... F16K 47/00; F16K 24/04

[52] U.S. Cl. ..... 251/120; 220/304; 251/144; 251/216

[58] Field of Search ..... 251/351, 120, 205, 208, 251/210, 216, 144, 145; 184/1.5; 137/351; 220/304

[56] References Cited

U.S. PATENT DOCUMENTS

| | | | |
|---|---|---|---|
| 1,690,183 | 11/1928 | Stoughton | 251/216 |
| 1,993,534 | 3/1935 | Stoltz | 251/216 |
| 2,082,827 | 6/1937 | Gaber | 251/216 |
| 2,471,716 | 5/1949 | Bell | 220/304 |
| 3,384,338 | 5/1968 | Dermody | 251/205 |
| 3,578,285 | 6/1969 | Carlton | 251/144 |
| 3,910,572 | 10/1975 | Denler | 251/216 |
| 3,958,604 | 5/1976 | Stoltman | 251/120 |

*Primary Examiner*—Robert I. Smith

*Attorney, Agent, or Firm*—Peter A. Taucher; John E. McRae; Nathan Edelberg

[57] ABSTRACT

An engine oil pan having a threaded drain opening sealed by a removable plug. An auxiliary passage is formed in the plug, whereby the plug can be partially unscrewed from the drain opening to discharge metered quantities of water, sludge and similar impurities that accumulate from time to time at the bottom of the pan. The metered flow can be easily stopped when it turns into clean oil.

1 Claim, 7 Drawing Figures

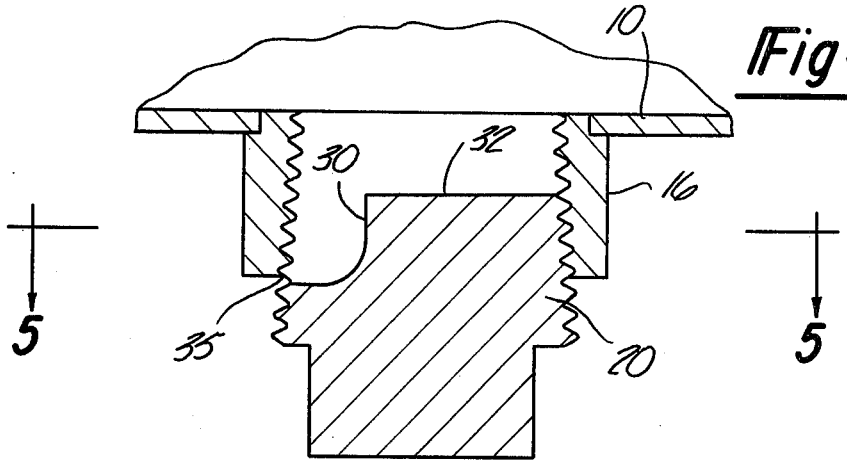
Fig-4
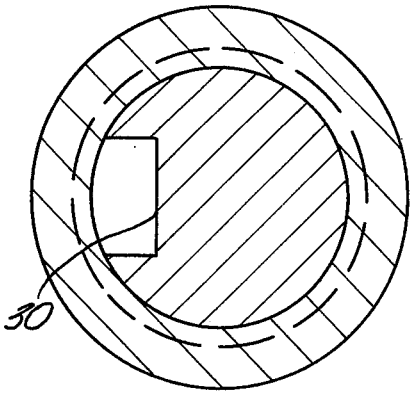
Fig-5
Fig-6
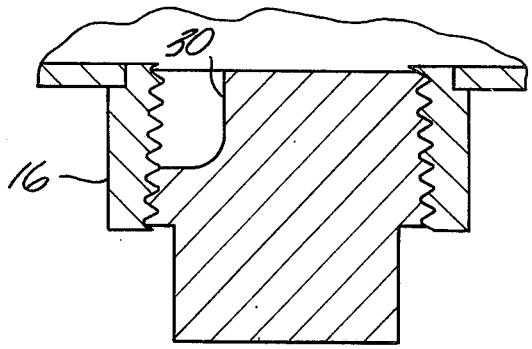
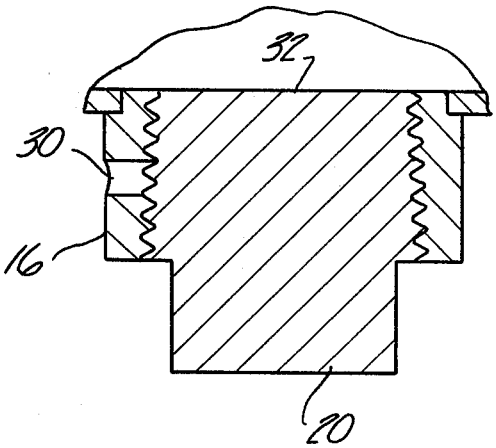
Fig-7

METERING DRAIN PLUG

BACKGROUND AND SUMMARY OF THE INVENTION

Engine oil pan drain plugs, as exemplified for example in U.S. Pat. No. 2,214,268 issued in the name of T. E. Brooks, are screw-type devices that must be completely removed from the threaded fitting on the pan before oil, water or sludge starts to flow. When it is desired to discharge small quantities of liquid impurity, principally water and sludge, it becomes difficult to quickly replace the plug in the threaded opening to stop the flow within a satisfactory time interval. Usually the oil and impurity gush out of the opening, thus creating a hydraulic flow force that tends to prevent the plug from being centered in the threaded opening. Accordingly an unduly large quantity of oil is wasted through the discharge opening before the plug is sufficiently screwed into the opening to seal the escape path.

The present invention contemplates a drain plug having an auxiliary passage therein that discharges a metered quantity of liquid when the plug is only partially unscrewed from the threaded opening. Thus, it is possible to conduct a liquid impurity-removal operation without completely removing the plug from the opening. Therefore it is not necessary to center the plug against a disturbing hydraulic force, as is the case with conventional plugs not equipped with the auxiliary passage.

The invention described herein may be manufactured, used, and licensed by or for the Government for governmental purposes without payment to me of any royalty thereon.

THE DRAWINGS

FIG. 4 is a view similar to FIG. 1, but taken through a second embodiment of the invention.

FIG. 5 is a sectional view taken on line 5—5 in FIG. 4.

FIG. 6 illustrates the arrangement of FIG. 4 with the plug thereof completely screwed into the fitting.

FIG. 7 is a sectional view taken through a third embodiment of the invention.

Figure 1:
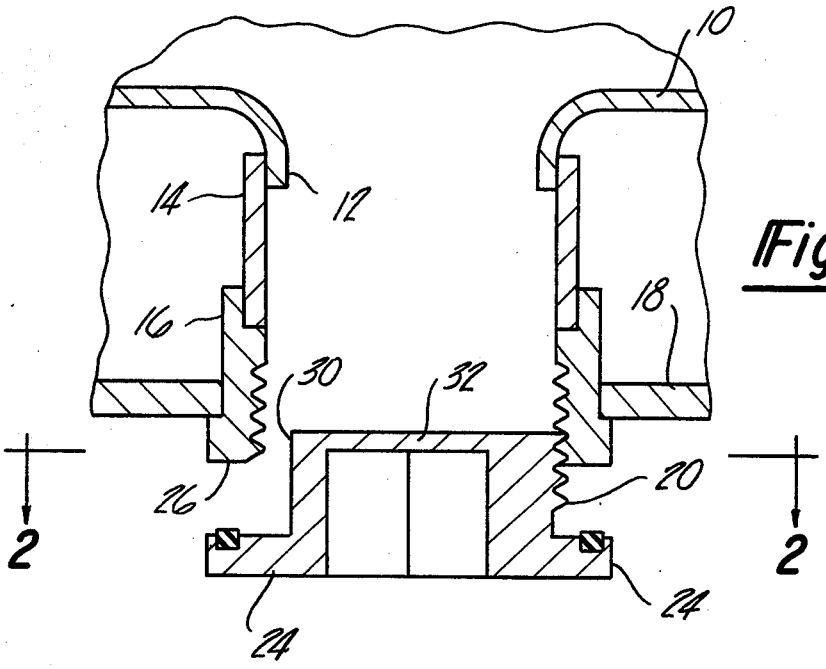
FIG. 1 is a sectional view taken through a drain fitting and sealant plug incorporating this invention. The plug is shown partially unscrewed from the threaded fitting.
Figure 2:
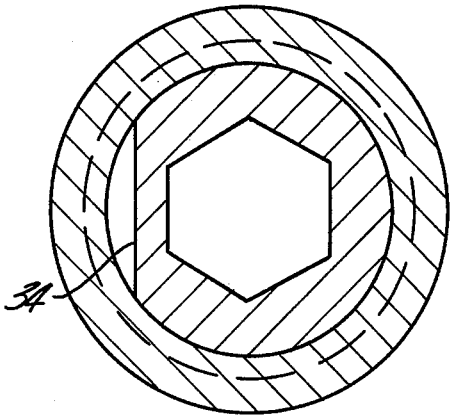
FIG. 2 is a sectional view on line 2—2 in FIG. 1.
Figure 3:
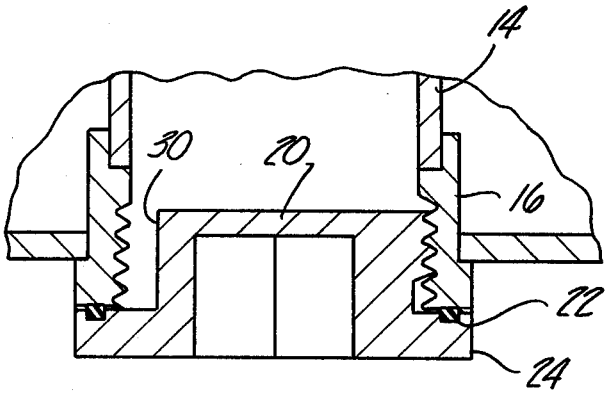
FIG. 3 is a view similar to FIG. 1 but showing the plug completely screwed into the fitting.

This invention is particularly applicable for use on engine fuel tanks or oil reservoirs. The drawings illustrate usage on an oil pan. Referring in greater detail to the drawings, especially FIGS. 1 through 3, there is shown the bottom wall 10 of a conventional engine oil pan, said bottom wall having a flanged opening 12 which connects with a vertical tube 14 extending upwardly from a threaded fitting 16 suitably mounted on a bottom wall 18 of a vehicle such as a military truck. Fitting 16 and tube 14 formed a passage for gravitational discharge of oil from the superjacent pan to the ambient atmosphere. This passage is normally closed by an externally threaded plug 20 that is adapted to be screwed upwardly into the fitting from an open position detached from the fitting. FIG. 1 illustrates the plug partially screwed into the fitting, and FIG. 3 illustrates the plug fully screwed into the fitting. A resilient compressible sealing ring 22 is suitably mounted on the upper surface of plug flange 24 to engage the lower edge 26 of fitting 16 when the plug is in its FIG. 3 position. Ring 22 prevents escape of oil from the pan during normal operation of the vehicle.

Over protracted time intervals it is possible for sludge and/or water to form and accumulate at the bottom of the drain pan. A major portion of this sludge-water mixture gravitates into tube 14. Periodically it is desirable from a maintenance standpoint to remove or purge the water-sludge impurity from the system. For this purpose there is formed in the side surface of the plug a small area auxiliary passage 30. This auxiliary passage extends from the plug upper surface 32 to the flange 24. As seen in FIG. 2, this passage is defined by a flat 34 machined into the plug side surface. As the plug is unscrewed from the fitting 16 to a partially unscrewed position (FIG. 1) the flange 24 moves away from the lower edge 26 of fitting 16, thereby permitting a metered flow of liquid impurity through the port defined by passage 30. Since the plug is not completely separated from fitting 16 during this partial-unscrew operation the flow can be accurately controlled and terminated when the discharged liquid appears as a clean oil or fuel stream.

The auxiliary passage 30 would ordinarily not be used to completely drain the oil pan because the low flow rate would necessitate relatively long time intervals. Instead the plug would be completely removed from the fitting, as per conventional practice. The plug-fitting system is designed to have the metered flow capability for impurity purging, coupled with the high flow capability for rapid oil or fuel drain-out. It is contemplated that auxiliary passage 30 would have a flow area less than one quarter the flow area of fitting 16 (with plug 20 detached therefrom).

FIGS. 4 through 6 illustrate a second embodiment of the invention wherein the fitting 16 is mounted directly on the bottom wall 10 of the drain pan. The threaded area of the fitting is tapered for engagement with tapered threads on the plug 20. The plug is a conventional item modified to have a slot-like passage 30 extending downwardly from its upper surface 32 to a point above the lower termination of the threads on the plug side surface. Therefore when the plug is screwed upwardly into the fitting to the FIG. 6 position the threaded area of the plug below the slot 30 will seal against escape of oil and/or impurity from the pan. When the plug is partially unscrewed from the fitting, as for example to the position of FIG. 4, water-sludge impurity can be discharged through the port 35 formed by passage 30. As with the previously described embodiment, the plug can be completely removed from fitting 16 when it is necessary to remove the entire oil mass from the pan.

FIG. 7 illustrates a third embodiment of the invention wherein a auxiliary discharge passage 30 is formed in the tubular fitting 16. When the plug 20 is partially unscrewed from the fitting 16 its upper surface 32 will eventually move to a position below passage 30, thereby allowing oil impurity to discharge from the pan to the atmosphere.

FIGS. 4 through 7 may not function quite as well as the embodiment of FIG. 1, since such embodiments do not include sludge-accumulation tubes similar to tube 14. However the embodiments of FIGS. 4 through 7 have the advantage of ready usage with a wide variety of existing vehicles without extensive modification or retrofit cost. The embodiment of FIG. 4 utilizes an existing fitting; the only modification involves the formation of a slot 30 in the otherwise conventional plug 20. The modification required in the FIG. 7 embodiment consists of drilling a single hole 30 through the wall of the fitting 16.

I wish it to be understood that I do not desire to be limited to the exact details of construction shown and described for obvious modifications will occur to a person skilled in the art.

I claim:

1. In combination: an engine oil pan having a tubular fitting oriented to define a vertical escape passage for gravity discharge of dirty oil from the pan to a subjacent collection vessel; the inner surface of the tubular fitting being internally threaded along its length; an externally threaded plug adapted to be screwed upwardly into and downwardly out of the threaded fitting between a first position fully detached from the fitting and a second position sealing the liquid passage; said plug having an outwardly radiating flange at its lower end, said flange having an upper face that aligns axially with the lower edge of the tubular fitting; a resilient compressible sealing ring (22) carried on said flange for sealing engagement with the lower edge of the fitting when the plug is screwed into the fitting; the threaded surface of the plug having a flat (34) machined therein to define an auxiliary passage communicating the space above the plug with the space circumscribed by the sealing ring, whereby the plug can be partially unscrewed from the threaded fitting to permit discharge of metered liquid quantities from the oil pan; the upper edge of the tubular fitting being no higher than the interior bottom surface of the pan, whereby water and sludge impurity on the pan surface can readily reach the auxiliary passage.

* * * * *